US006226068B1

(12) United States Patent
Arcykiewicz et al.

(10) Patent No.: US 6,226,068 B1
(45) Date of Patent: May 1, 2001

(54) SELF-LOCKING BAYONET COUPLING MECHANISM

(75) Inventors: Robert R. Arcykiewicz, Bartlett, IL (US); Walter J. Olender, Shelby Township, MI (US); Kevin M. Harms, South Elgin, IL (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/384,055

(22) Filed: Aug. 27, 1999

(51) Int. Cl.[7] ..... H01R 4/54
(52) U.S. Cl. ..... 349/314; 439/318
(58) Field of Search ..... 439/314, 315, 439/317, 318, 319

(56) References Cited

U.S. PATENT DOCUMENTS

| | | | | |
|---|---|---|---|---|
| 959,226 | | 5/1910 | Keys . | |
| 2,293,635 | | 8/1942 | Wulle . | |
| 2,690,542 | | 9/1954 | Pearce et al. . | |
| 3,287,031 | * | 11/1966 | Simmos et al. . | |
| 3,302,195 | | 1/1967 | Fuller . | |
| 3,393,927 | | 7/1968 | Kelley et al. . | |
| 3,609,632 | | 9/1971 | Vetter . | |
| 3,674,287 | | 7/1972 | Selley . | |
| 3,805,379 | | 4/1974 | Vetter . | |
| 4,235,498 | * | 11/1980 | Snyder | 339/90 |
| 4,241,969 | * | 12/1980 | D'Amato et al. | 339/88 |
| 4,277,125 | | 7/1981 | Ball . | |
| 4,361,374 | | 11/1982 | Marmillion et al. . | |
| 4,440,464 | | 4/1984 | Spinner . | |
| 4,445,743 | | 5/1984 | Bakker . | |
| 4,457,469 | | 7/1984 | Ratchford . | |
| 4,464,001 | | 8/1984 | Collins . | |
| 4,479,689 | | 10/1984 | Marmillion et al. . | |
| 4,487,470 | * | 12/1984 | Knapp et al. | 339/89 |
| 4,502,748 | | 3/1985 | Brush, Sr. et al. . | |
| 4,519,661 | * | 5/1985 | Brush, Sr. et al. | 339/89 |
| 4,530,559 | * | 7/1985 | Burns et al. | 339/90 |
| 4,531,802 | | 7/1985 | Tomsa . | |
| 4,737,119 | | 4/1988 | Stieler . | |
| 4,741,706 | * | 5/1988 | Takeda et al. | 439/318 |
| 4,820,185 | | 4/1989 | Moulin . | |
| 5,015,195 | | 5/1991 | Piriz . | |
| 5,167,522 | | 12/1992 | Behning . | |
| 5,383,272 | * | 1/1995 | Mattingly et al. | 29/876 |
| 5,662,488 | | 9/1997 | Alden . | |
| 5,713,765 | | 2/1998 | Nugent . | |

* cited by examiner

*Primary Examiner*—Lincoln Donovan
*Assistant Examiner*—Thanh-Tam Le
(74) *Attorney, Agent, or Firm*—Blank Rome Comisky & McCauley, LLP

(57) ABSTRACT

An automatically locking bayonet coupling mechanism includes, a linear guide structure for preventing relative rotation between the coupler halves, a sleeve rotatably mounted on one of the coupler halves, a spring captured between the sleeve and the coupler half on which it is mounted to generate a torsional force between the sleeve and the coupler half, an L-shaped groove in the other of the coupler halves, and a bayonet pin extending from the sleeve and arranged to engage cam surfaces defined by edges of the groove. As the coupler halves are pushed together linearly, engagement between the bayonet pin and a first of the cam surfaces causes the sleeve to rotate against the force of the spring. Subsequently, the bayonet pin is caused to engage a second of the cam surfaces that forms a locking ramp. As the sleeve is caused to rotate into a locking position in response to the spring force, the angle of the locking ramp causes the spring force on the bayonet pin and locking ramp to also draw the coupler halves together, and to maintain the axial force that draws the coupler halves together after the bayonet pin comes to rest before the end of the locking ramp.

7 Claims, 3 Drawing Sheets

SELF-LOCKING BAYONET COUPLING MECHANISM

BACKGROUND OF THE INVENTION

1. Field of the Invention

This invention relates to a coupling mechanism, and in particular to a self-locking bayonet-type coupling mechanism of the type in which, following initial axial insertion of one coupler half in the other coupler half, a locking sleeve is automatically rotated into a locking position to prevent unintended decoupling due to shocks or vibrations. Unlike prior coupling mechanisms of this type, the invention further adds an axial coupling force which draws the coupler halves together during rotation of the locking sleeve into the locking position, and which is maintained continually following completion of coupling.

The coupler of the invention may be used in electrical, hydraulic, or pneumatic coupler systems, and is especially advantageous in coupler systems requiring sealing because it applies a continuous axial force to the interface between mated couplers.

2. Description of Related Art

Automatically locking couplers, in which a locking sleeve is rotated against a spring force during initial insertion of one coupler half into the other, and permitted to rotate back into a locking position upon completion of insertion, are known from U.S. Pat. Nos. 5,067,909 and 5,167,522.

These patents disclose a coupling mechanism, when one coupler half is inserted into the other half, a sleeve on one half is caused to rotate against a torsional spring force as a result of the camming action of complementary triangularly-shaped tabs on the sleeve and the inserted coupler half, the restoring force of the spring causes the sleeve to rotate into the locking position after the complementary tabs have passed each other so that the tabs prevent disengagement of the coupler halves until the sleeve is twisted to permit the tabs to clear each other during uncoupling.

A similar coupler is disclosed in U.S. Pat. No. 5,662,488 and illustrated in FIGS. 1–3 herein. In this coupler, L-shaped slots 1 in one coupler half 2 and bayonet pins 3 on a coupling sleeve 4 are used to rotate the coupling sleeve relative to the other coupler half 5, so that when the coupler half to which the sleeve is mounted is inserted axially into the other coupler half, a torsional restoring force forces the bayonet pin into the base of the L-shaped slot. Instead of utilizing a torsion spring, the torsional restoring force is provided by a second set of cam surfaces 6 on the inserted coupler half, which are arranged to cam a corresponding second set of pins 7 on resilient portions 8 of the sleeve in a radially outward direction, the torsional component of the restoring force on the second set of pins caused by the second set of cam surfaces causing the sleeve to rotate to the latching position when the first bayonet pin reaches the base of the L.

Inherent in both of these self-locking designs is the problem that a certain amount of play is necessary to permit the complementary locking structures, i.e., the triangular tabs of U.S. Pat. Nos. 5,067,909 and 5,167,522, and the bayonet pin and slot of U.S. Pat. No. 5,662,488, to clear each other so as to permit rotation into the locking position in response to the torsional force, and also as a result of manufacturing tolerances. The presence of play between the mating coupler halves increases wear on contacting parts, and in case of a sealed coupler, can compromise the seals at the interface between the mating halves of the coupler, causing the seals to acquire an elastic set due to failure of the coupler halves to bottom out or stay in the desired mating position.

On the other hand, it is known in the context of conventional, non-self locking coupling arrangements, to solve the problem of tolerances or play between mating connector halves by applying an axial force on the mating coupler halves. Examples of designs that apply a pre-load or axial force to the coupling include U.S. Pat. Nos. 3,805,379 and 4,820,185. In the design disclosed in U.S. Pat. No. 3,805,379, which is illustrated in FIG. 4 herein, the axial force results from rotating a bayonet coupling sleeve so that a bayonet pin traverses the corresponding groove past the point at which contact between the coupler halves is established and on to the end of the groove, against a purely axial pre-load provided by a spring arrangement. The component of the extended travel distance in the direction of mating defines the pre-load on the coupler halves.

Because the pre-load of the illustrated conventional bayonet coupler is applied at the end of travel of the bayonet in the corresponding groove, completion of coupling requires an increase in the manually applied rotational force, starting at the point of contact, at which point the pre-load spring starts to compress. As a result, this arrangement is unsuitable for use in an automatic locking mechanism of the type disclosed in U.S. Pat. Nos. 5,067,909, 5,167,522, and 5,662,488, in which the force applying springs are compressed during initial insertion. In addition, the conventional axial pre-load arrangement is unable to accommodate manufacturing tolerances that might affect the actual pre-load.

The present invention, on the other hand, combines the axial pre-load of U.S. Pat. No. 3,805,379 and the self-latching arrangements of U.S. Pat. Nos. 5,067,909, 5,167,522, and 5,662,488, by using a modified torsional force generating arrangement rather than the purely axial force of the mechanism illustrated in U.S. Pat. No. 3,805,379, to generate both the rotational and axial forces, and thereby provide a coupler that eliminates the disadvantages of both prior types of coupler. In the present invention, not only is a torsional force applied to the latching sleeve to cause it to move into a latching position, but a transverse component of the torsional force is also utilized to draw the halves of the coupler together while at the same time rotating the sleeve into the latching position.

No other prior coupling mechanism offers the combination, provided by the invention, of a coupler in which the halves of the coupler are both drawn together and locked so that the coupler halves can be mated using a purely linear motion with a minimum of effort, movement of the couplers into the final mated position being accomplished automatically without the need for human intervention or the possibility of incompletely mating due to lack of feedback.

SUMMARY OF THE INVENTION

It is accordingly an objective of the invention to provide a coupling mechanism of the type including a locking sleeve that automatically locks the mating halves of the coupler together, and that continually draws the coupler halves together both during and after mating, using shared force generating elements.

It is a second objective of the invention to provide a mechanism for permitting connection of two coupler halves with reduced mating and unmating time, that provides feedback of a successful coupling, and that provides a positive anti-vibration and anti-shock coupling force.

It is a third objective of the invention to provide a coupling arrangement for a connector that allows for connection with a straight axial push and no other intervention, and yet that can be decoupled with only a slight turn.

It is a fourth objective of the invention to provide a coupling arrangement for a connector that provides forces that continually draw the mating halves of the connector together following mating.

It is a fifth objective of the invention to provide a bayonet coupling mechanism that provides shell-to-shell bottoming, removing the eventual and permanent "elastic set" characteristic of an elastomeric seal between mating surfaces.

It is a sixth objective of the invention to provide a bayonet coupling mechanism having a simple structure and yet which eliminates the need for additional anti-vibration features and procedures, such as "safety-wiring" the coupling sleeve to a stationary point.

It is a seventh objective of the invention to provide a coupling mechanism that will be resistant to axial wear through the elimination of movement between mated halves, with true metal-to-metal bottoming of all mating components.

These objectives are achieved, in accordance with the principles of a preferred embodiment of the invention by providing a coupling mechanism that resides on a parent coupler half of a mating connector pair, and includes a coupling sleeve that houses a plurality of torsional force producing members, which may include but are not limited to helical springs, and which reside between the coupling sleeve and the parent coupler half. The torsional force is translated to a plurality of pins or bayonets that reside in the coupling sleeve, the pins or bayonets being arranged to engage sides of grooves which form tracks for guiding their movement, and therefore the movement of the coupling sleeve, as the parent coupler is inserted linearly into the other coupler half.

Originating from the torsional effect created by the force members inside the coupling sleeve, the resultant force exerted by the pin on a properly angled final track section or locking ramp, produces a self-drawing effect that keeps the mated halves together, providing shock and vibration resistance while at the same time simplifying the coupling procedure, permitting connection to occur with a straight axial push and no other intervention.

Unlike prior coupler locking arrangements, the invention achieves the axial pre-load or continuous force-applying effect with an especially simple structure, involving a single set of force producing members, bayonet pins, and grooves, that nevertheless provides for all of the features achieved separately by the conventional coupler arrangements, and advantages such as improved ease-of-use, reliability, and accommodation of manufacturing tolerances, that are not present in any of the conventional coupler arrangements.

With respect to accommodation of manufacturing tolerances and other dimensional accuracies, the present invention achieves a desired continuous axial force despite manufacturing tolerances, temperature-related dimensional changes in the coupler parts, or other sources of inaccuracy such as friction wear or fatigue, by permitting the bayonet pin in the mated condition to reside anywhere along the final track section of locking ramp, rather than requiring it to reside at the end of the ramp. As a result, the locking mechanism of the invention automatically compensates for dimensional inaccuracies or tolerances in the mating surfaces, including the tracks, pins, or mating halves that make up the true metal-to-metal shell bottoming.

DETAILED DESCRIPTION OF THE PREFERRED EMBODIMENTS

The coupler of the preferred embodiment of the invention includes first and second generally cylindrical coupler halves 20 and 21 arranged to be moved into a mating position along a common axis, and a latching sleeve 22 rotatably mounted on the second, or parent, coupler half. As illustrated, coupler half 20 is a female coupler half or receptacle and coupler half 21 is a male coupler half or plug arranged to be inserted into coupler half 20, although it is also possible to provide the sleeve on the inside of the coupler so that the coupler half on which it is mounted could serve as the receptacle for the other coupler half.

Figure 6:
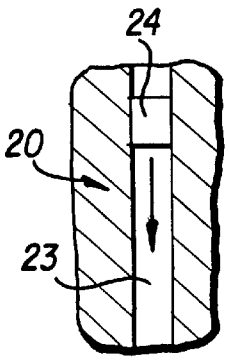
FIG. 6 is a plan view of a linear guide track provided in the coupling arrangement of FIG. 1.

As shown in FIG. 6, axial alignment between the coupler halves 20 and 21 is maintained during mating by complementary interengaging linear guide structures in the form of slots 23,23' on an interior surface of coupler half 20 and projections 24 on an exterior surface of coupler 21. While not specifically illustrated, it is of course possible to vary the size and spacing of the projections to provide a keying effect to ensure proper rotational alignment of the coupler halves. In addition, it will be appreciated by those skilled in the art that the projections 24 could be placed instead on the coupler half 20 and the slots 23,23' on coupler half 21, that the number and exact configuration of the slots and projections may be varied so long as they guide one of the coupler halves linearly into the other coupler half, and that it is also within the scope of the invention to provide guide structures other than slots and grooves, for example by configuring the exterior of a mating portion of coupler half 21 to have a non-cylindrical shape, and the interior of the mating portion of coupler half 20 to have a corresponding non-cylindrical shape.

Figure 1:
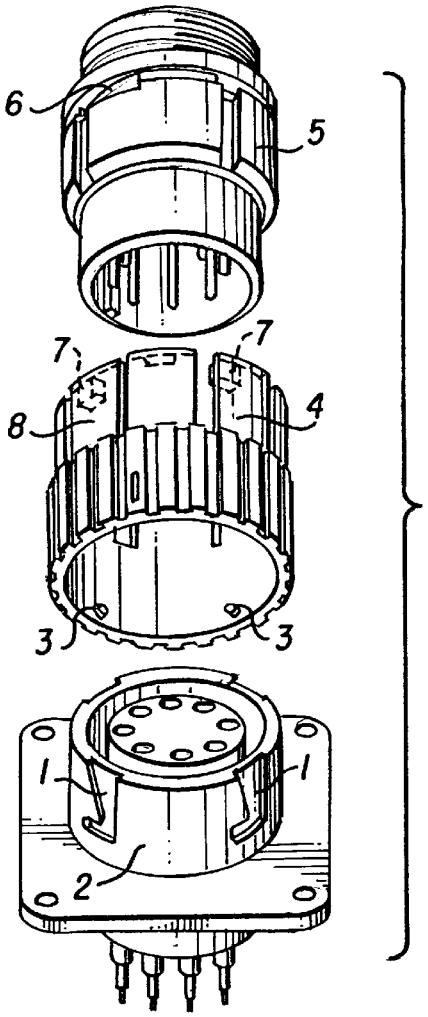
FIG. 1 (PRIOR ART)
FIG. 1 is an exploded isometric view of a conventional self-latching coupler arrangement.
Figure 2:
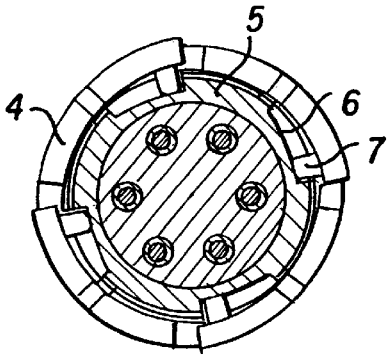
FIG. 2 (PRIOR ART)
FIG. 2 is a cross-sectional view of the force generating portion of the coupler arrangement of FIG. 1.
Figure 3:
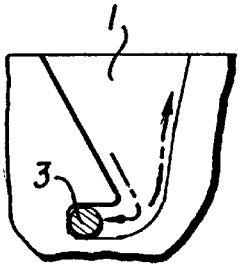
FIG. 3 (PRIOR ART)
FIG. 3 is a plan view of a camming arrangement for the coupler arrangement of FIG. 1.
Figure 4:
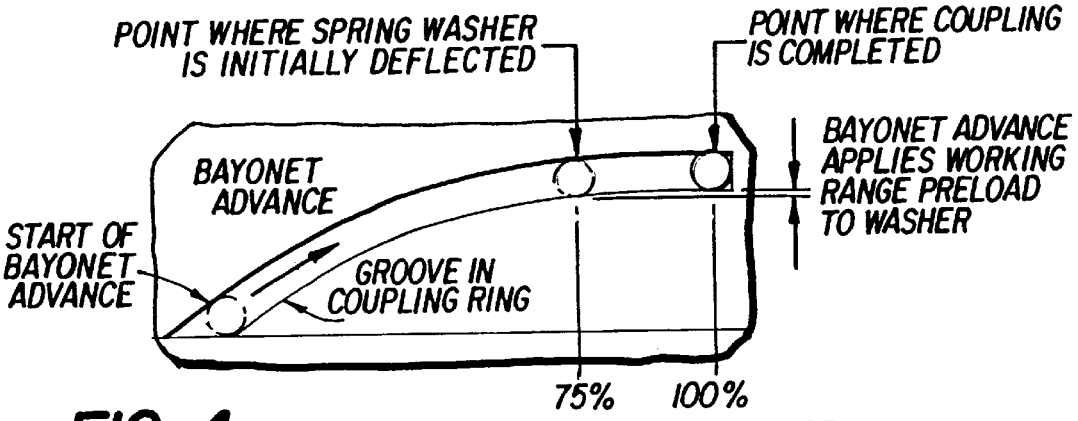
FIG. 4 (PRIOR ART)
FIG. 4 is a schematic view of a pre-load arrangement for a conventional non-self-latching bayonet coupler.

The coupler halves may be arranged to house electrical connector inserts, or hydraulic or pneumatic elements. Details of the inserts or elements within the coupler halves are not illustrated, but will be well-known to those skilled in the art, a suitable electrical connector insert being shown by way of example in FIGS. 1 and 2. In addition, those skilled in the art will appreciate that the connectors halves and sleeve may be made of any materials appropriate to the application in which the coupler is used, such as metal for the coupler halves and bayonet pins, and plastic for the sleeve.

Figure 5:
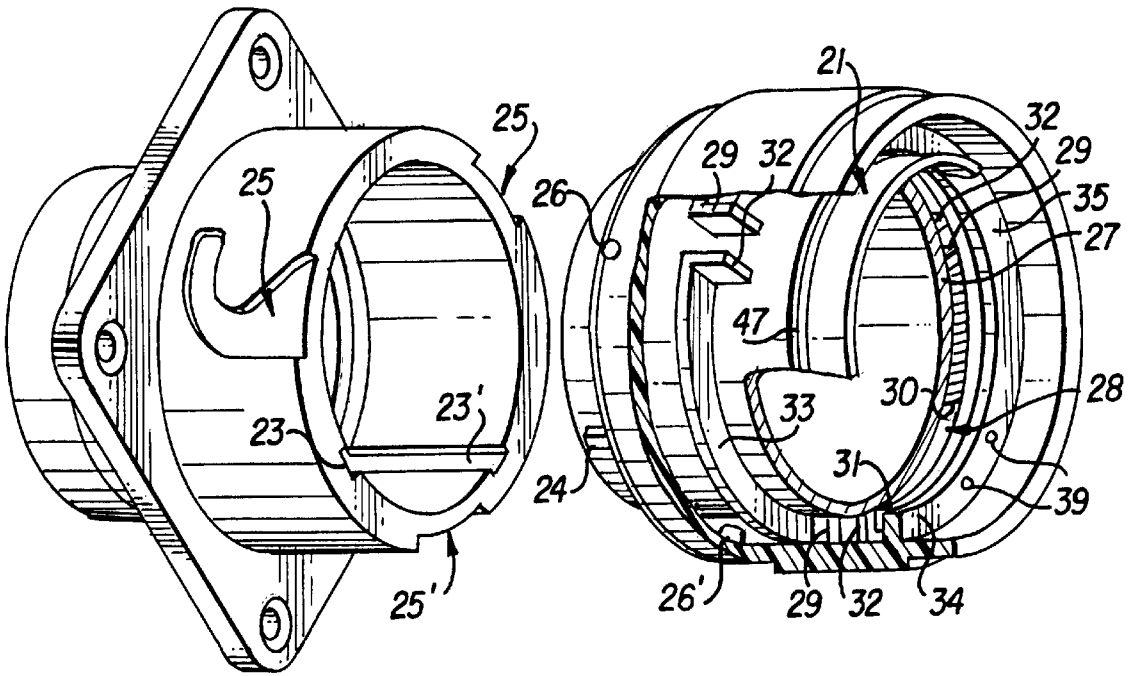
FIG. 5 is an isometric view of a bayonet coupling arrangement constructed in accordance with the principles of a preferred embodiment of the invention, with portions of a sleeve and coupler half shown in cross-section.

In the illustrated embodiment, both the self-twisting and axial bias functions are provided by a combination of three generally L-shaped slots or grooves 25,25',25" cut or formed in the exterior of the first coupler half 20, a corresponding number of inwardly extending bayonet pins 26,26' (only two of which are shown in FIG. 5) mounted in the rotatable sleeve 22, and three force producing members 27 (only one of which is shown in FIG. 5). Force producing members 27 are captured between stops 28 extending inwardly from the rotatable sleeve 22 and stops 29 extending radially outwardly from the second coupler half 21 so as to generate a force that causes relative rotation of the sleeve and second coupler half, rotation of the second coupler half being constrained by engagement between projections 24 extending from the second coupler half 21 and linear guide slots 23 in the first coupler half 21, as illustrated in FIG. 6. Stops 28 each includes two end surfaces 30 and 31, end surfaces 30 engaging one end of the springs and end surfaces 31 serving to limit rotation of the sleeve relative to the coupler half by engaging second stops 32 extending radially outwardly from the second coupler half. When surfaces 31 engage stops 32, the sleeve is in its initial position and bayonet pins 26,26' are position to enter L-shaped grooves 25,25',25", as will be explained in more detail below.

Figure 5A:
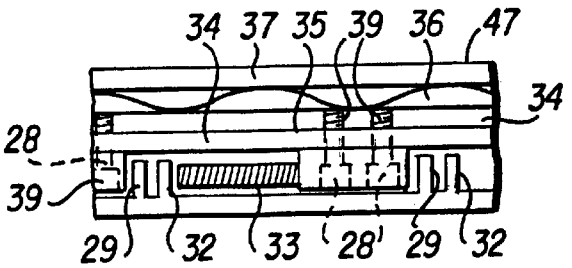
FIG. 5A is a plan view showing details of the manner in which the coupling sleeve is secured on one of the coupler halves.
Figure 7:
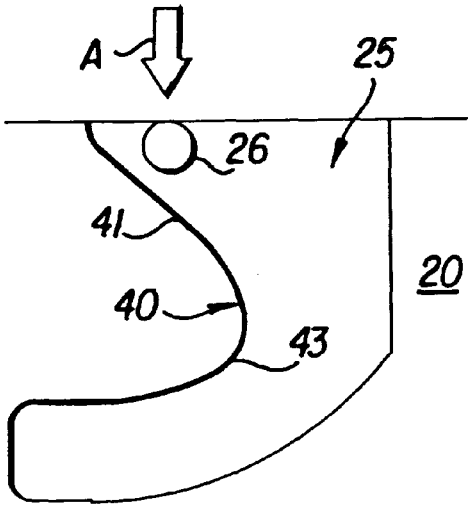
FIGS. 7–10 are plan views illustrating the manner in which a bayonet pin and a groove cooperate to provide self-latching and axial force applying functions in the coupling arrangement of FIG. 5.

The rotatable sleeve 22 may be held on the second coupler half 21 by any suitable means. For example, as best illustrated in FIG. 5A, a bottom surface of stop 28 is arranged to engage a top surface of outwardly extending flange 33 on coupler half 21, from which stops 32 extend, while the top surface 35 of flange 34 on the sleeve 21, from which stops 28 extend, is engaged by a wave washer structure 36 secured by a retaining ring 37 extending from the second coupler. Stops 28 may be secured to flange 34 by threaded fastening member 39.

The illustrated force producing members 27 are in the form of helical springs having ends that engage stops 28 and 29, the springs also being captured between flange 33 of the second coupler half 21 and flange 34 on sleeve 22, so that the springs normally bias end surface 30 of stop 28 on sleeve 22 against stop 32 extending from the second coupler half 21. Although helical springs are illustrated, however, those skilled in the art will appreciate that other types of resilient biasing arrangements may be freely substituted, so long as they are capable of supplying sufficient torsional force to the sleeve to ensure that the coupler halves will be continually drawn together as described in more detail below.

In order to assemble rotatable sleeve 22 to coupler half 21 using the illustrated helical spring structure, coupler half 21 is held in one hand while one end of helical spring 27 is carefully positioned against the outer face of stop 32 and held at approximately a 45 degree angle towards the back end of coupler half 21, away from alignment keys 24. This is repeated at the other two stops of coupler half 21. Coupling sleeve 22 is then installed onto the back of coupler half 21 with the bayonet pins facing towards alignment keys 24 on coupler half 21. At the same time, the free ends of the helical springs are brought into contact with end surface 31 of stops 28 on coupling sleeve 22. As coupling sleeve 22 and coupler half 21 are brought further together, it is necessary to rotate the two parts in a manner that compresses the helical springs. With these springs compressed, the coupling sleeve and coupler half can be brought fully together to where the bottom surface of stop 28 engages the top surface of outwardly extending flange 33 on coupler half 21. Holding the coupling sleeve and the coupler half together, wave washer 36 is installed and engages with upper surface 35 of flange 34 as shown in FIGS. 5 and 5A. Following the wave washer 36 is the retaining ring 37 that falls into a groove 47 extending into the outer circumference of coupler half 21 such that when the ring is installed it engages and compresses wave washer 36. The compression of wave washer 36 by retaining ring 37 in turn keeps the bottom surface of stop 28 in constant engagement with the top surface of outwardly extending flange 33 on coupler half 21.

The manner in which the sleeve is rotated against the action of the helical spring 27, and according to which the coupler halves are drawn together by cooperation between the bayonet pins and grooves, is illustrated in FIGS. 7–10. The left edge of grooves 25,25',25", hereinafter referred-to collectively as groove 25, form a track 40 that controls movement of the sleeve relative to the two coupler halves as they are guided linearly into the mating position by cooperation between projection 24 and slot 23, as illustrated in FIG. 6.

At the beginning of the track, a straight feature 9 assists in proper alignment of the two mating halves. In particular, when the coupler half halves are initially brought together and aligned by inserting projections 24 into grooves 23,23', bayonet pin 26 will enter groove 25 vertically, as indicated by arrow A, and engage the track 40 at a point 41 below the entrance to the groove. At the point 41 where bayonet pin 26 engages track 40, it is deflected to the right and begins to follow cam portion 42 of the track, as shown in FIG. 8, against the force of the spring 27, indicated by arrow B, causing sleeve 22 to rotate in the direction of arrow C relative to the aligned coupler halves 20 and 21.

Figure 8:
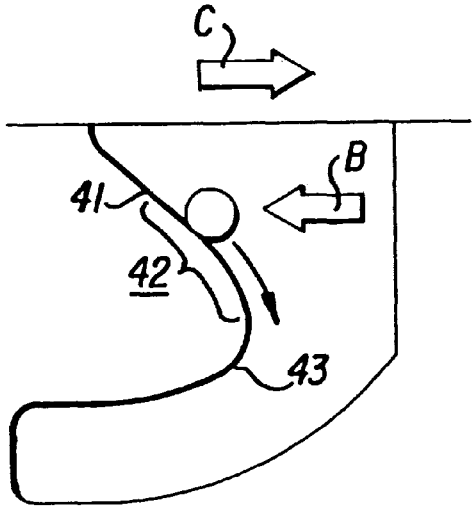
Figure 9:
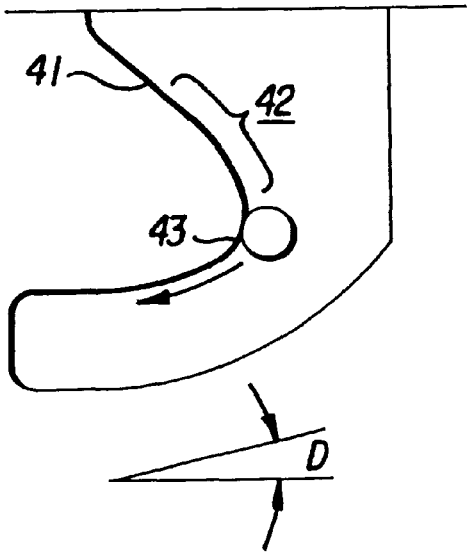
Figure 10:
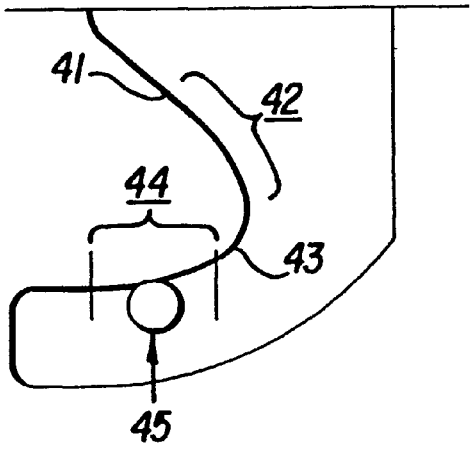

As the pin 26 approaches the top of the track angle, as shown in FIG. 8, the maximum amount of torsion is produced in the coupling sleeve. As the pin moves past the point of stability 43, i.e., around the radius found between the two track features 42 and 44, the pin begins to move in the direction of arrow B in response to the force generated by force generating elements or springs 27, and traffics across the final track portion or locking ramp 44, resting on this portion for the duration of the mate. Optionally, it is possible to include a vertically extending straight portion after angled section 42 and prior to point 43 in order to decrease the angle of section 42 and increase the axial forces necessary to mate the connector halves Locking ramp 44 extends at an angle D relative to horizontal, i.e. relative to the line traverse to the mating direction. As a result, as the sleeve 22 rotates in direction B in response to the spring force, engagement between ramp 44 and bayonet pin 26 forces the sleeve to also move downwards. Since axial movement of the sleeve 22 relative to coupler half 21 is limited by engagement between the bottom surface of stops 28 and the top surface of flange or collar 33, movement of the sleeve 22 in the downward mating direction will also force coupler half 21 in the mating direction until a limit of travel is reached, which occurs when the mating coupler halves have contacted each other or bottom out. This occurs at point 45 on the ramp.

The resultant force exerted by the torsional force of force generating element 27 on the locking ramp 44 keeps the mated halves drawn together. By design, the bayonet pin 26 in the mated condition rests within the second linear quarter of the locking ramp 44, but can reside anywhere along the ramp angle to automatically compensate for any frictional wear and fatigue in the mating surfaces, including the tracks, pins, or shells of the mating coupler halves that make-up the true metal-to-metal shell bottoming at the interface between the mating coupler halves.

Decoupling of the coupler halves can easily be carried out by manually twisting the sleeve 22 against the spring force so that bayonet pin 26 clears point 43 and can be withdrawn from the groove 25, the sleeve automatically rotating back to its initial position as the two coupler halves are pulled apart.

Although a preferred embodiment of the invention has been described with sufficient particularity to enable a person skilled in the art to make and use the invention without undue experimentation, it will be appreciated that numerous other variations and modifications of the illustrated embodiments, in addition to those already noted above, may be made by those skilled in the art. Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

We claim:

1. A coupling arrangement, comprising:

a first coupler half;

a second coupler half arranged to be coupled to the first coupler half;

complementary interengaging linear guide structures on the first and second coupler halves for guiding said second coupler half linearly into a coupled position relative to the first coupler half;

a sleeve rotatably mounted on the second coupler half;

a rotational force generating structure captured between said sleeve and said second coupler half for generating a rotational bias force that causes said sleeve to rotate in a first direction;

a cam structure on the first coupler half and a follower structure on the sleeve for causing said sleeve to rotate relative to the first coupler half in a second direction against said rotational bias force when said first coupler half is guided linearly relative to said second coupler half towards said coupled position;

a locking ramp on the first coupler half for engaging said follower structure and causing said first and second coupler halves to be drawn together following disengagement of said follower from said cam structure as said sleeve rotates in said first direction in response to said rotational bias force; wherein said cam structure and said locking ramp are formed by edge surfaces of an arcuate-shaped groove in the side of said first coupler half, said groove having an axial portion extending in a generally axial direction of said coupling arrangement, the edge surface of which forming said cam structure and a traverse portion extending generally transversely to the axial portion;

said transverse portion of the groove including an edge surface inclined at an acute angle to said second rotational direction forming said locking ramp such that as the sleeve is rotated in said second direction in response to said force, said first and second coupler halves are drawn together.

2. A coupling arrangement as claimed in claim 1, wherein said force generating means includes at least one spring.

3. A coupling arrangement as claimed in claim 2, wherein said spring is a helical coil spring captured between said sleeve and said second coupler half.

4. A coupling arrangement as claimed in claim 1, wherein said follower structure includes a pin extending inwardly from said sleeve.

5. A coupling arrangement as claimed in claim 1, wherein said axial portion of said groove includes a surface inclined at a non-zero angle in said second direction such that as said first and second coupler halves are pushed together, said sleeve is caused to rotate in said second direction, said surface of the axial portion of the groove forming said the cam structure.

6. A coupling arrangement as claimed in claim 1, wherein said surface of said transverse portion of the groove is arranged such that when said first and second coupler halves are fully mated, said follower is positioned between end portions of said surface, whereby said first and second coupler halves continue to be drawn together by said force in said mated position, said position between said end portions being sufficient large to accommodate tolerances in dimensions of said coupler halves or sealing arrangements present at a mating interface.

7. A coupling arrangement as claimed in claim 1, wherein said interengaging linear guide structures include a projection extending outwardly from said second coupler half and a groove in an inside surface of said first coupler half.

* * * * *

UNITED STATES PATENT AND TRADEMARK OFFICE

CERTIFICATE OF CORRECTION

PATENT NO. : 6,226,068 B1
DATED : May 1, 2001
INVENTOR(S) : Arcykiewicz et al.

It is certified that error appears in the above-identified patent and that said Letters Patent is hereby corrected as shown below:

Column 8,
Line 27, delete "the" (third occurrence).
Line 36, change "sufficient" to -- sufficiently --.

Signed and Sealed this

Twenty-fifth Day of June, 2002

*Attest:*

*Attesting Officer*

JAMES E. ROGAN
*Director of the United States Patent and Trademark Office*